US010827281B2

(12) United States Patent
Fukuyama et al.

(10) Patent No.: US 10,827,281 B2
(45) Date of Patent: Nov. 3, 2020

(54) AUDIO OUTPUT DEVICE

(71) Applicants: LG ELECTRONICS INC., Seoul (KR); KYOCERA CORPORATION, Kyoto (JP)

(72) Inventors: Yutaka Fukuyama, Tokyo (JP); Yukio Hiratsuka, Tokyo (JP); Heeburm Ryu, Tokyo (JP); Kousei Horiuchi, Kyoto (JP)

(73) Assignees: LG ELECTRONICS INC., Seoul (KR); KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/342,495

(22) PCT Filed: Feb. 1, 2017

(86) PCT No.: PCT/KR2017/001070
§ 371 (c)(1),
(2) Date: Apr. 16, 2019

(87) PCT Pub. No.: WO2018/074674
PCT Pub. Date: Apr. 26, 2018

(65) Prior Publication Data

US 2019/0238995 A1 Aug. 1, 2019

(30) Foreign Application Priority Data

Oct. 17, 2016 (KR) ..... 10-2016-0134440

(51) Int. Cl.
*H04R 17/00* (2006.01)
*H04R 19/02* (2006.01)
(Continued)

(52) U.S. Cl.
CPC ..... *H04R 17/00* (2013.01); *H04R 1/00* (2013.01); *H04R 3/00* (2013.01); *H04R 19/02* (2013.01); *H04R 2201/003* (2013.01)

(58) Field of Classification Search
CPC ..... H04R 17/00; H04R 17/02; H04R 17/025; H04R 17/005
See application file for complete search history.

(56) References Cited

U.S. PATENT DOCUMENTS

2010/0274138 A1* 10/2010 Mizunuma ..... B06B 1/0629 600/459
2011/0038495 A1* 2/2011 Jeong ..... H04R 17/00 381/190

(Continued)

FOREIGN PATENT DOCUMENTS

GB 2488534 9/2012
KR 1020110016667 2/2011

(Continued)

OTHER PUBLICATIONS

PCT International Application No. PCT/KR2017/001070, Written Opinion of the International Searching Authority dated May 31, 2017, 17 pages.

(Continued)

*Primary Examiner* — Matthew A Eason
(74) *Attorney, Agent, or Firm* — Lee, Hong, Degerman, Kang & Waimey PC

(57) ABSTRACT

In order to solve problems with an audio device that is difficult to machine and has an increased amount of wiring, the present invention provides an audio output device comprising: a first electrode layer including a plurality of rows of electrodes arranged in a first direction; a second electrode layer disposed on the back surface of the first electrode layer and including a plurality of rows of electrodes arranged in a second direction; a driving layer including a piezoelectric (Continued)

layer disposed between the first electrode layer and the second electrode layer and a support layer coupled to one of the front surface and the back surface of the piezoelectric layer; and a support plate coupled to the back surface of the driving layer and having a hollow portion formed in a region corresponding to each of intersections between the plurality of rows of electrodes in the first electrode layer and the plurality of rows of electrodes in the second electrode layer intersect.

8 Claims, 11 Drawing Sheets

(51) Int. Cl.
*H04R 3/00* (2006.01)
*H04R 1/00* (2006.01)

(56) References Cited

U.S. PATENT DOCUMENTS

2013/0136280 A1* 5/2013 Stephanou ..... H04R 31/00 381/190
2013/0294636 A1 11/2013 Cassett et al.

FOREIGN PATENT DOCUMENTS

KR 101151844 6/2012
KR 101520070 5/2015
KR 1020160015348 2/2016

OTHER PUBLICATIONS

European Patent Office Application Serial No. 17861604.1, Search Report dated Apr. 30, 2020, 8 pages.

* cited by examiner

AUDIO OUTPUT DEVICE

CROSS-REFERENCE TO RELATED APPLICATIONS

This application is the National Stage filing under 35 U.S.C. 371 of International Application No. PCT/KR2017/001070, filed on Feb. 1, 2017, which claims the benefit of earlier filing date and right of priority to Korean Application No. 10-2016-0134440, filed on Oct. 17, 2016, the contents of which are all hereby incorporated by reference herein in their entireties.

TECHNICAL FIELD

The present invention relates to an audio output device using piezoelectric elements.

BACKGROUND ART

As disclosed in PCT Publication No. 2009/066290, a digital speaker under development is known for using Micro Electro-Mechanical Systems (MEMS). Since a digital speaker using MEMS needs a great deal of time and money, it is not appropriate for mass production.

Since an MEMS digital speaker includes a large-size semiconductor, it the MEMS digital speaker is productized, it is difficult to achieve considerable cost reduction thereafter. For example, for the usage of a TV that requires a sound pressure over 70 dB Sound Pressure Level (SPL) at 1 m or more in case of playing a sound at the frequency of 100 Hz, an MEMS digital speaker is more expensive than a current dynamic speaker. Moreover, since an MEMS digital speaker is driven at high voltage in order to drive a vibrating plate with an electrostatic force, it is hardly applicable to mobile devices.

Regarding a digital speaker that can be manufactured by an uncomplicated process with obviation of the above-described tasks, as disclosed in Japanese Patent Application Publication No. 2013-5889, a backing material consists of a plastic material of metal oxide or resin and a vibrating plate of metal material is proposed to use. Yet, such a method still has the following tasks that may become problematic.

First of all, since amplitude needs to be uniform in order to generate a uniform sound pressure from each diaphragm unit, a gap between the diaphragm unit and an electrode needs to be uniform. As a diaphragm unit vibrates at amplitude of several μm, a backing material on the upper/lower side needs a layout of precision less than μm in all areas. Yet, a member formed of a plastic material of metal oxide or a member formed of resin material is unable to secure accuracy without mechanical processing. Moreover, if both an upper board and a lower board are deformed, it is realistically impossible to perform processing while a gap between a diaphragm unit and an electrode is maintained uniform in all areas.

Secondly, there may be a problem of internal voltage securing. A diaphragm unit vibrates by being driven with an electrostatic force generated by the applied voltage of tens of volts. When this voltage is applied, a diaphragm unit adheres to a voltage-applied electrode by being attracted to the corresponding electrode. In this case, although an insulating layer is necessary for the prevention of electrical leakage, it is difficult to secure an internal voltage of tens of voltage with the thickness less than μm. Moreover, if the thickness of an insulating layer is increased, an interval voltage increases but a problem that the amplitude of a diaphragm unit decreases is caused.

Thirdly, there may be a wiring problem between a diaphragm unit and a driver circuit. Since this mechanism drives the diaphragm unit independently, driver circuits twice more than diaphragm units are necessary. And, wire patterns amounting to the same number thereof are necessary as well. According to this proposal, although the number of diaphragm units is 256, since 1,024 diagrams are necessary for the TV usage for example, the number of wires is too high to route wires in the gap of an adjacent diaphragm, whereby physical connection becomes impossible.

DISCLOSURE OF THE INVENTION

Technical Task

A technical task of the present invention is to solve the problems of the difficult processing and the increase of the number of wires in the related art audio device.

Technical Solutions

In one technical aspect of the present invention, provided herein is an audio output device, including a first electrode layer including electrodes arranged in a plurality of columns in a first direction, a second electrode layer provided to a backside of the first electrode layer, the second electrode layer including electrodes arranged in a plurality of columns in a second direction, a drive layer including a piezoelectric layer provided between the first electrode layer and the second electrode layer and a support layer coupled to either a front side or a backside of the piezoelectric layer, and a support plate coupled to a backside of the drive layer, the support plate having a hollow portion formed in an area corresponding to points at which the electrodes in a plurality of the columns of the first electrode layer and the electrodes in a plurality of the columns of the second electrode layer intersect with each other, respectively.

According to another aspect of the present invention, intersections between a plurality of the electrode columns of the first electrode layer and a plurality of the electrode columns of the second electrode layer may form a matrix of (n, m) (where the n and m are positive integers).

According to another aspect of the present invention, the audio output device may further include a flexible PCB providing voltage to the first electrode layer and the second electrode layer and a driver circuit applying voltage to at least one of a plurality of the electrode columns of the first electrode layer and at least one of a plurality of the electrode columns of the second electrode layer through the flexible PCB, wherein the piezoelectric layer and the support layer vibrate in response to an intersection between the voltage applied electrode columns of the first and second electrode layers.

According to another aspect of the present invention, the flexible PCB may include a first circuit unit selectively applying the voltage to each of the electrodes in a plurality of the columns of the first electrode layer by being connected to the electrodes in a plurality of the columns of the first electrode layer at one side of the first direction and a second circuit unit selectively applying the voltage to each of the electrodes in a plurality of the columns of the second electrode layer by being connected to the electrodes in a plurality of the columns of the second electrode layer at one side of the second direction.

According to another aspect of the present invention, the first circuit unit and the second circuit unit may be provided to the front side and the backside of the piezoelectric layer, respectively.

According to another aspect of the present invention, the flexible PCB may include a first circuit unit selectively applying the voltage to each of the electrodes in a plurality of the columns of the first electrode layer by being connected to the electrodes in a plurality of the columns of the first electrode layer and a second circuit unit selectively applying the voltage to each of the electrodes in a plurality of the columns of the second electrode layer by being connected to the electrodes in a plurality of the columns of the second electrode layer.

According to another aspect of the present invention, the audio output device may further include a plurality of perforated holes formed in the piezoelectric layer and an auxiliary connection wire connected to each of a plurality of the column electrodes of the second electrode layer on a rear side of the piezoelectric layer, the auxiliary connection wire provided across the front side of the piezoelectric layer by passing through the perforated hole, wherein the first circuit unit and the second circuit unit are provided to the front side of the piezoelectric layer and wherein the second circuit unit is connected to the auxiliary connection wire.

According to another aspect of the present invention, the first circuit unit and the second circuit unit may be provided to one side of the first direction and each of the electrode columns of the second electrode layer and each column of the auxiliary connection wire may form a specific angle in-between.

According to another aspect of the present invention, the specific angle may be vertical.

Advantageous Effects

Effects of an audio output device according to the present invention are described as follows.

According to at least one of embodiments of the present invention, a device can be downsized advantageously.

According to at least one of embodiments of the present invention, a processing of a device is facilitated advantageously.

According to at least one of embodiments of the present invention, a device can be driven advantageously through relatively less wiring.

According to at least one of embodiments of the present invention, electrodes in a row direction and electrodes in a column direction can be connected all advantageously through wiring provided to one side.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BEST MODE FOR INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

As disclosed in PCT Publication No. 2009/066290, a digital speaker under development is known for using Micro Electro-Mechanical Systems (MEMS). Since a digital speaker using MEMS needs a great deal of time and money, it is not appropriate for mass production.

Since an MEMS digital speaker includes a large-size semiconductor, it the MEMS digital speaker is productized, it is difficult to achieve considerable cost reduction thereafter. For example, for the usage of a TV that requires a sound pressure over 70 dB Sound Pressure Level (SPL) at 1 m or more in case of playing a sound at the frequency of 100 Hz, an MEMS digital speaker is more expensive than a current dynamic speaker. Moreover, since an MEMS digital speaker is driven at high voltage in order to drive a vibrating plate with an electrostatic force, it is hardly applicable to mobile devices.

Regarding a digital speaker that can be manufactured by an uncomplicated process with obviation of the above-described tasks, as disclosed in Japanese Patent Application Publication No. 2013-5889, a backing material consists of a plastic material of metal oxide or resin and a vibrating plate of metal material is proposed to use. Yet, such a method still has the following tasks that may become problematic.

Figure 1:
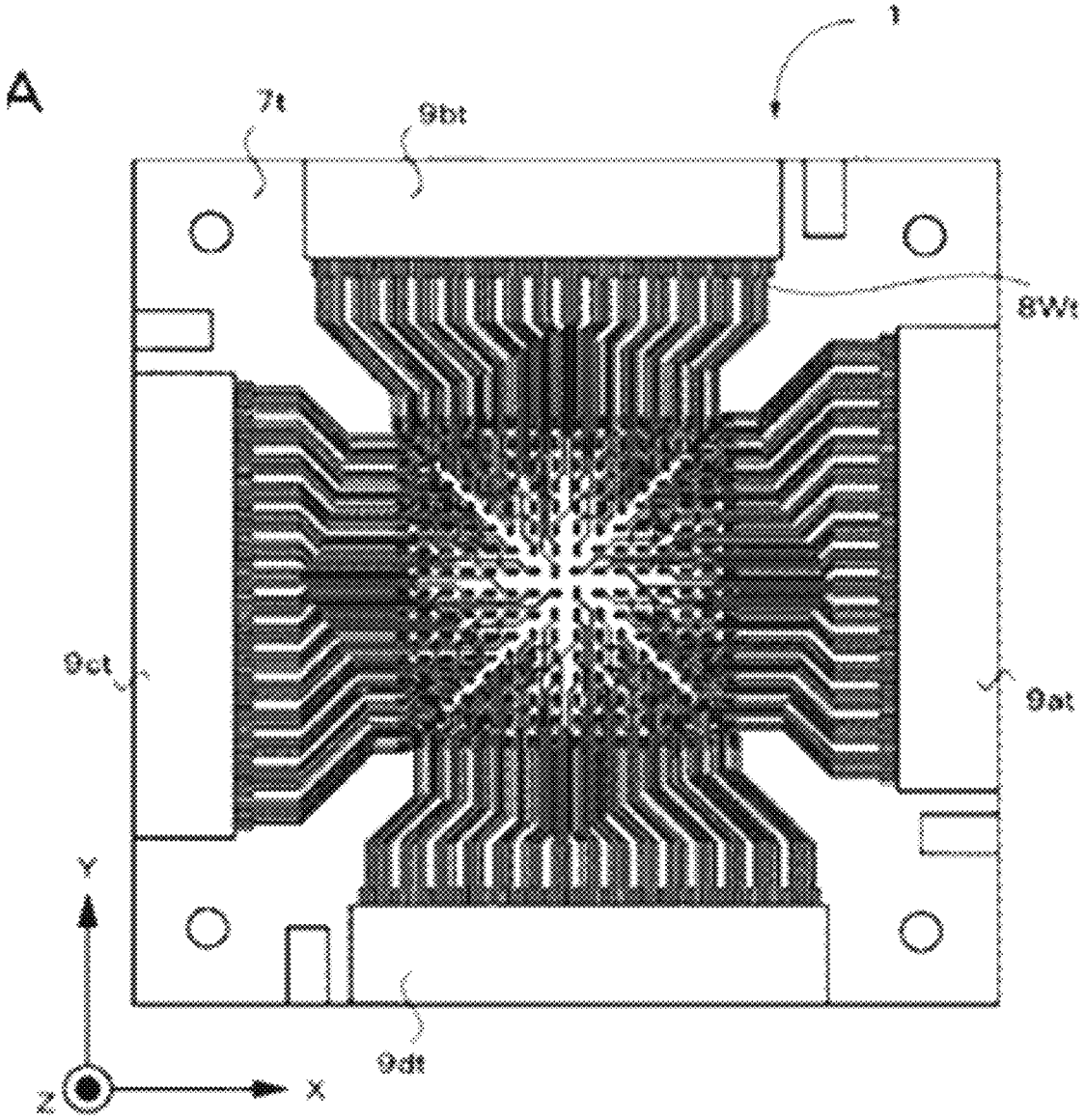
FIG. 1 is a layout of a speaker according to a related art.
Figure 2:
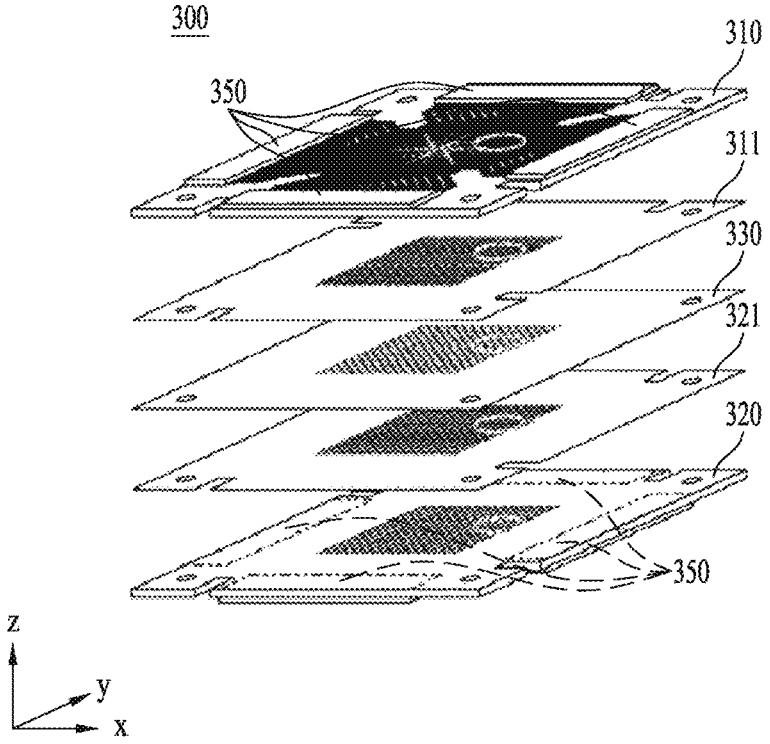
FIG. 2 is a diagram showing configuration of a speaker according to a related art.

FIG. 1 is a layout of a speaker according to a related art, and FIG. 2 shows configuration of the speaker. An upper spacer 311 and a lower spacer 321 exist between a top member 310 and a bottom member 320, and a vibrating member 330 is provided between the upper spacer 311 and the lower spacer 321.

Figure 3:
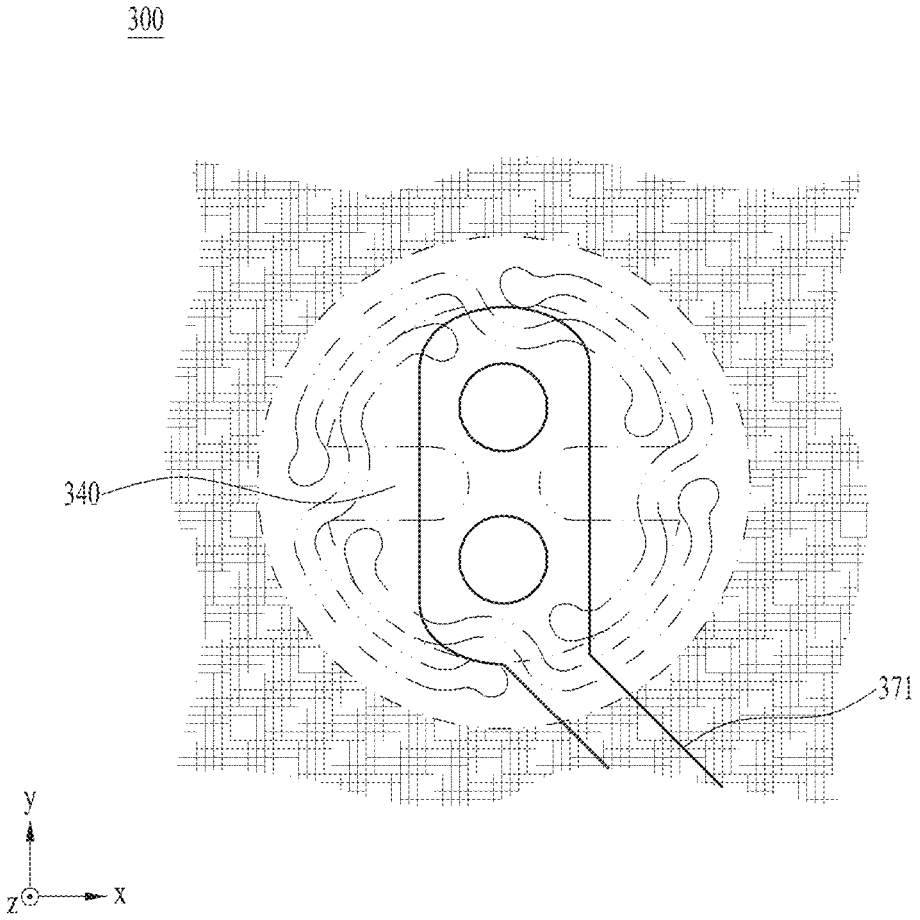
FIG. 3 is an enlarged diagram of a diaphragm unit shown in FIG. 2.
Figure 4:
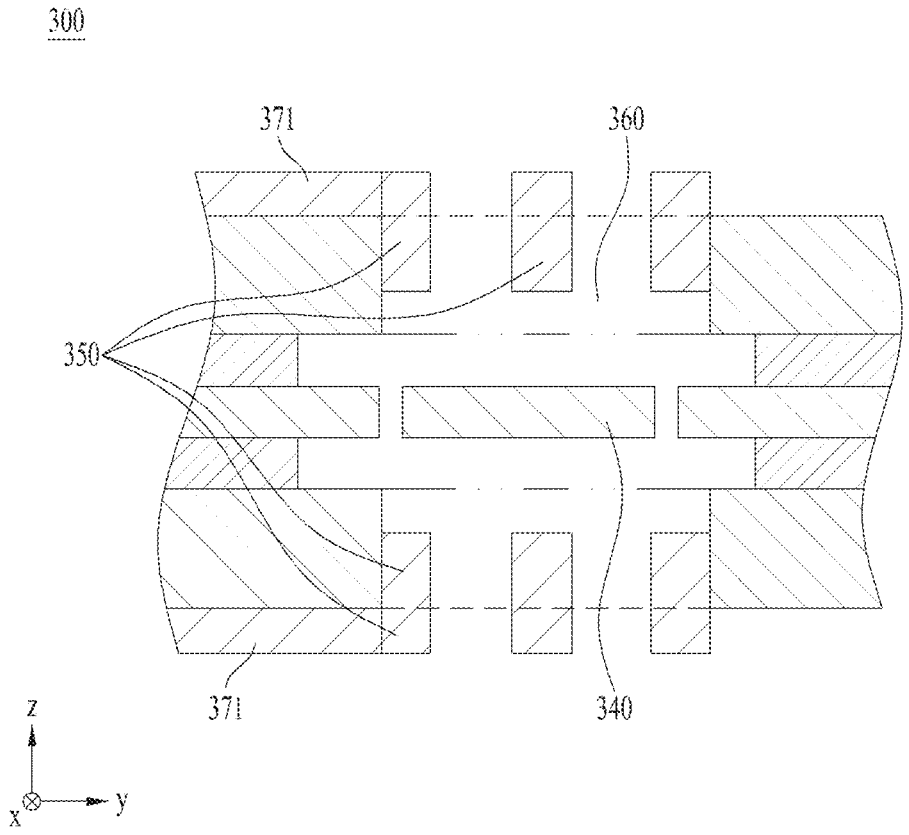
FIG. 4 is a cross-sectional diagram along a direction Y shown in FIG. 3.

FIG. 3 is an enlarged diagram of a diaphragm unit shown in FIG. 2, and FIG. 4 is a cross-sectional diagram along a direction Y shown in FIG. 3.

A plurality of diaphragm units 340 are disposed in a central part of the vibrating member 330. The diaphragm unit 340 generates a sound pressure in a direction Z.

The above-configured speaker of the related art may have the following problems.

First of all, since amplitude needs to be uniform in order to generate a uniform sound pressure from each diaphragm unit 340, the gap 351 between the diaphragm unit 340 and the electrode 350 needs to be uniform. As the diaphragm unit 340 vibrates at amplitude of several μm, a backing material on the upper/lower side needs a layout of precision less than μm in all areas. Yet, a member formed of a plastic material of metal oxide or a member formed of resin material is unable to secure accuracy without mechanical processing. Moreover, if both an upper board and a lower board are deformed, it is realistically impossible to perform processing while the gap 360 between the diaphragm unit 340 and the electrode 350 is maintained uniform in all areas.

Secondly, there may be a problem of internal voltage securing. The diaphragm unit 340 vibrates by being driven with an electrostatic force generated by the applied voltage of tens of volts. When this voltage is applied, the diaphragm unit 340 adheres to the voltage-applied electrode 350 by being attracted to the corresponding electrode. In this case, although an insulating layer is necessary for the prevention of electrical leakage, it is difficult to secure an internal voltage of tens of voltage with the thickness less than μm. Moreover, if the thickness of an insulating layer is increased, an interval voltage increases but a problem that the amplitude of the diaphragm unit 340 decreases is caused.

Thirdly, there may be a wiring problem between the diaphragm unit 340 and a driver circuit. Since this mechanism drives the diaphragm unit 340 independently, driver circuits 360 twice more than diaphragm units 340 are necessary. And, wire patterns 371 amounting to the same number thereof are necessary as well. According to this proposal, although the number of the diaphragm units 340 is 256, since 1,024 diagrams are necessary for the TV usage for example, the number of wires is too high to route wires in the gap of an adjacent diaphragm, whereby physical connection becomes impossible.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

Figure 5:
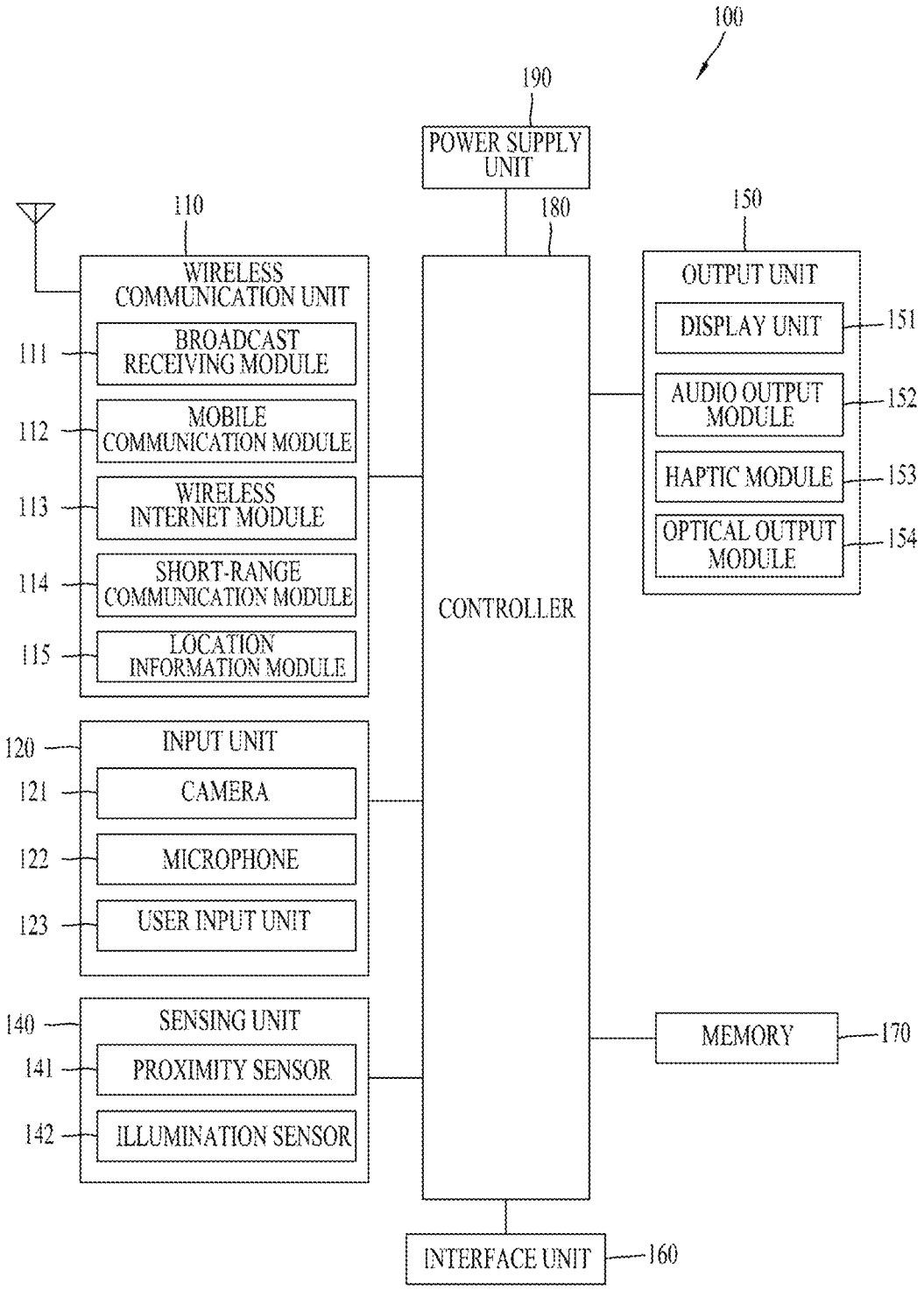
FIG. 5 is a block diagram to describe an audio output device related to the present invention.

FIG. 5 is a block diagram of an audio output device in accordance with the present disclosure.

The audio output device 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components in The FIG. 5 is not a requirement, and that greater or fewer components may alternatively be implemented.

More specifically, the wireless communication unit 110 typically includes one or more modules which permit communications such as wireless communications between the audio output device 100 and a wireless communication system, communications between the audio output device 100 and another audio output device, communications between the audio output device 100 and an external server. Further, the wireless communication unit 110 typically includes one or more modules which connect the audio output device 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the audio output device, the surrounding environment of the audio output device, user information, and the like. For example, the sensing unit 140 may alternatively or additionally include other types of sensors or devices, such as a proximity sensor 141 and an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The audio output device 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154. The display unit 151 may have an inter-layered structure or an integrated structure with a touch sensor in order to facilitate a touch screen. The touch screen may provide an output interface between the audio output device 100 and a user, as well as function as the user input unit 123 which provides an input interface between the audio output device 100 and the user.

The interface unit 160 serves as an interface with various types of external devices that can be coupled to the audio output device 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the audio output device 100 may perform assorted control functions associated with a connected external device, in response to the external device being connected to the interface unit 160.

The memory 170 is typically implemented to store data to support various functions or features of the audio output device 100. For instance, the memory 170 may be configured to store application programs executed in the audio output device 100, data or instructions for operations of the audio output device 100, and the like. Some of these application programs may be downloaded from an external server via wireless communication. Other application programs may be installed within the audio output device 100 at time of manufacturing or shipping, which is typically the case for basic functions of the audio output device 100 (for example, receiving a call, placing a call, receiving a message, sending a message, and the like). It is common for application programs to be stored in the memory 170, installed in the audio output device 100, and executed by the controller 180 to perform an operation (or function) for the audio output device 100.

The controller 180 typically functions to control overall operation of the audio output device 100, in addition to the operations associated with the application programs. The controller 180 may provide or process information or functions appropriate for a user by processing signals, data, information and the like, which are input or output, or activating application programs stored in the memory 170.

To drive the application programs stored in the memory 170, the controller 180 may be implemented to control a predetermined number of the components mentioned above in reference with FIG. 5. Moreover, the controller 180 may be implemented to combinedly operate two or more of the components provided in the audio output device 100 to drive the application programs.

The power supply unit 190 can be configured to receive external power or provide internal power in order to supply appropriate power required for operating elements and components included in the audio output device 100. The power supply unit 190 may include a battery, and the battery may be configured to be embedded in the terminal body, or configured to be detachable from the terminal body.

Figure 6:
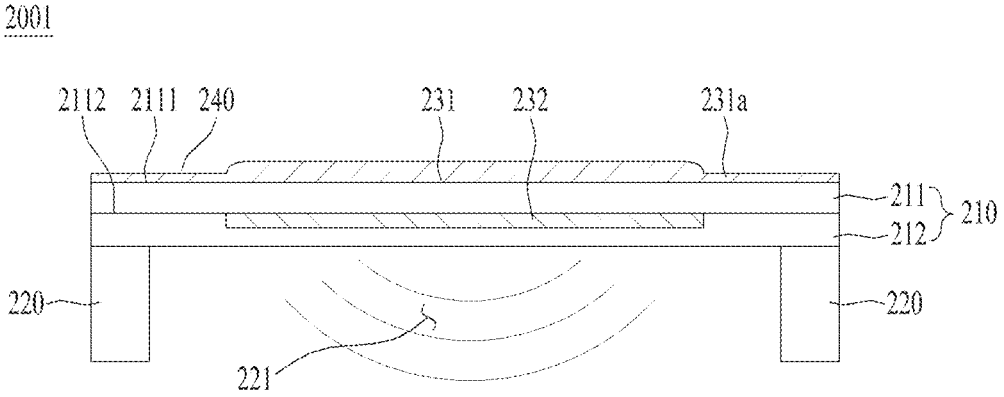
FIG. 6 is a cross-sectional diagram of a drive unit of an audio output device related to the present invention.

FIG. 6 is a cross-sectional diagram of a drive unit 2001 of the audio output device 100 related to the present invention.

The drive unit 2001 can configure a portion of a drive module 200 that will be described later. A plurality of the drive units 200 gather to configure the drive module 200.

The drive unit 200 of the audio output device 100 may mean a part that directly generates a sound by receiving a digital audio signal.

The audio output device 100 may be configured in a manner that a piezoelectric layer 211 and a support layer 212 overlap each other. The piezoelectric layer 211 and the support layer 212 configure a drive layer 210 and may behave as a single member.

The piezoelectric layer 211 may include a piezoelectric material. If a voltage is applied to the piezoelectric layer 211, the piezoelectric layer 211 can expand or contract.

A first electrode layer 231 and a second electrode layer 232 are provided to a front side and a backside of the piezoelectric layer 211 so as to play a role in providing or delivering a voltage to the piezoelectric layer 211.

If both sides of the piezoelectric layer 211 are defined as a first face 2111 and a second face 2112, a first electrode layer 231 and a second electrode layer 232 may be provided to the first face 2111 and the second face 2112, respectively.

According to the present embodiment, the first face 2111 and the second face 2112 are assumed as becoming the front side and the backside of the piezoelectric layer 211, respectively. On the contrary, the first face 211 and the second face 212 may become the backside and the front side of the piezoelectric layer 211, respectively.

The support layer 212 may be provided in a manner of being coupled to one of the front side and the backside of the piezoelectric layer 211. For clarity, the following description shall be made with reference to a case that the support layer 212 is coupled to the backside of the piezoelectric layer 211, i.e., the second face 2112. Even if the support layer 212 is coupled to the front side of the piezoelectric layer 211, the same features are applied and the same effects may be caused.

The piezoelectric layer 211 may expand or contract in a horizontal direction particularly by an applied voltage. The support layer 212 is coupled to the piezoelectric layer 211, thereby providing a relative displacement in which the piezoelectric layer 211 will vibrate.

The support layer 212 receives an asymmetric force that one lateral side of the support layer 212 is expanded/contracted by horizontal extension/contraction of the piezoelectric layer 211 and may be then curved in a vertical direction by the effect of the asymmetric force.

If the support layer 212 is curved in the vertical direction, the piezoelectric layer 211 coupled to the support layer 212 shows the same behavior.

As the voltage application is periodically repeated, if the expansion and contraction of the piezoelectric layer 211 are repeated, the drive layer 210 vibrates according to such repetition. And, such bending vibration generates a sound pressure, whereby a sound is generated.

The support layer 212 may include a material having elasticity capable of expansion and contraction in length in order to play the above-described role. If necessary, the support layer 212 may be provided in form of a piezoelectric element formed of the same material of the piezoelectric layer 211.

A support plate 220 may provide a hollow portion 221 that is a space in which the drive layer 210 can vibrate. Namely, the support plate 220 is formed in the rest of the drive layer 210 except an area that needs vibration, thereby playing a role in supporting the drive layer 210.

The hollow portion 221 is formed between the support plates 220 so that the drive layer 210 can vibrate within the hollow portion 221.

An area in which the hollow portion 221 is formed may include an area corresponding to points at which electrodes in a plurality of columns (described later) of the first electrode layer 231 and electrodes in a plurality of columns (described later) of the second electrode layer 232 intersect with one another, respectively.

A plurality of drive units 2001 may be provided and connected to other drive units 2001. A plurality of the drive units 2001 may be connected on a horizontal plane in a longitudinal or transverse direction. This shall be described in detail later.

Figure 7:
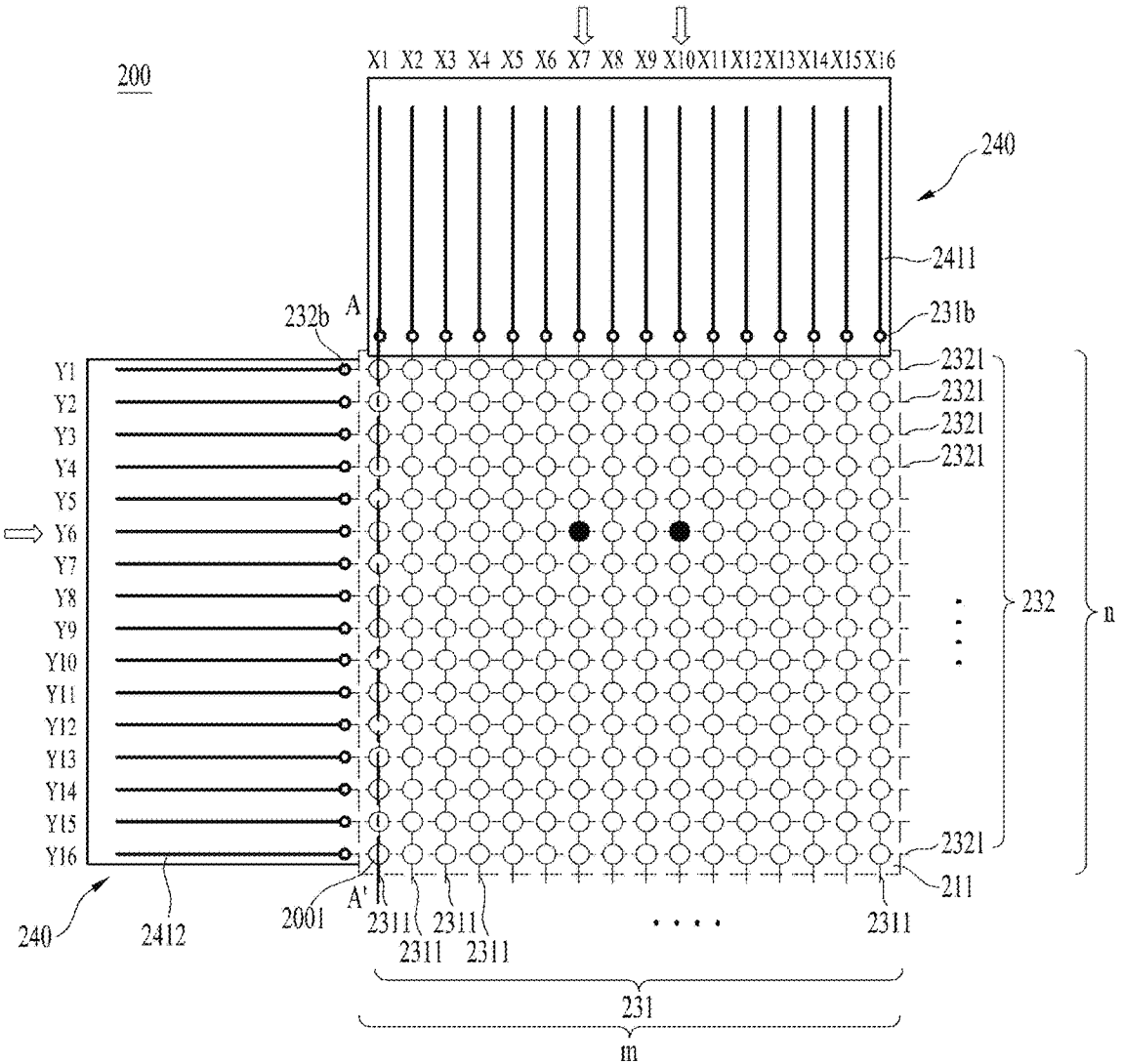
FIG. 7 is a schematic layout of a drive module of an audio output device related to the present invention.

FIG. 7 is a schematic layout of a drive module 200 of the audio output device 100 related to the present invention.

The drive unit 2001 shown in FIG. 6 is a single member and may play a role as a vibrating plate of the audio output device 100. Alternatively, as shown in FIG. 7, a plurality of drive units 100 are provided so as to operate as a single module.

Particularly, a plurality of the drive units 2001 may be disposed in a matrix form having rows and columns. A plurality of the drive units 2001 may have a rectangular (m,n) matrix arrangement like the present embodiment or a matrix arrangement that forms a circular outer boundary according to structural property.

A first electrode layer 231 and a second electrode layer 232, which connect a plurality of the drive units 2001 electrically, may be provided in a direction that the respective electrode columns 2311 and 2321 cross with each other.

The first electrode layer 231 may connect a plurality of the drive units 2001 to the electrodes 2311 of a plurality of the columns in a first direction, and the second electrode layer 232 may connect a plurality of the drive units 2001 to the electrodes 2321 of a plurality of the columns in a second direction.

According to the present embodiment, the first direction of the first electrode layer 231 may mean a column direction, and the second direction of the second electrode layer 232 may mean a row direction. Yet, it is a matter of course that the first and second directions are changeable.

In case that the drive units 2001 configure the (m,n) matrix arrangement, the first electrode layer 231 may have an electrode of $m^{th}$ column and the second electrode layer 232 may have an electrode of $n^{th}$ column.

By the first electrode layer 231 and the second electrode layer 232 including the electrodes in a plurality of the columns, the drive module 200 may show a behavior in a passive matrix drive manner.

A driver circuit 273 may selectively apply a voltage to a desired column among a plurality of the electrode columns 2311 of the first electrode layer 231 only and also apply a voltage to a desired column among a plurality of the electrode columns 2321 of the second electrode layer 232 only in the same manner.

The drive unit 2001 corresponding to a point, at which the at least one voltage-applied electrode column 2311 of the first electrode layer 231 and the at least one voltage-applied electrode column 2321 of the second electrode layer 232 intersect, vibrates, whereby a sound pressure is generated.

For example, a voltage is assumed as applied to columns X7 and X10 among a plurality of the electrode columns 2311 of the first electrode layer 231 and a voltage is assumed as applied to a column Y6 among a plurality of the electrode columns 2321 of the second electrode layer 232. In this case, the drive layer 210 of the drive unit 2001 corresponding to the intersection (X7, Y6) and the drive layer 210 of the drive unit 2001 corresponding to the intersection (X10, Y6) vibrate, thereby generating sounds.

According to this passive matrix drive mechanism, a wiring structure can be rapidly simplified in comparison to the mechanism of vibrating each drive unit 2001 independently.

For example, assuming the drive unit 2001 of a (16, 16) matrix having 16 rows and 16 columns, the total number of the drive units 2001 amounts to 256. In case of the mechanism of vibrating each drive unit 2001 independently, there are 256 top electrodes and 256 bottom electrodes of the drive unit 2001 and 1 general electrode, whereby total 513 wires are required.

On the other hand, in case of the passive matrix drive mechanism, there are 16 electrode columns of the first electrode layer 231 and 16 electrode columns of the second electrode layer 232, whereby total 32 wires are required only.

A plurality of the electrode columns of the first electrode layer 231 and the second electrode layer 232 may be electrically connected to a flexible PCB 240.

The flexible PCB 240 may include a first circuit unit 2411 electrically connected to each of the electrodes in a plurality of the columns of the first electrode layer 231. And, the flexible PCB 240 may include a second circuit unit 2412 electrically connected to each of the electrodes in a plurality of the columns of the second electrode layer 232.

The first circuit unit 2411 may have columns of which number is equal to the number of the electrodes in a plurality of the columns of the first electrode layer 231. The second circuit unit 2412 may have columns of which number is equal to the number of the electrodes in a plurality of the columns of the second electrode layer 232.

The driver circuit 273 can apply a voltage to at least one column among the electrodes 2311 in a plurality of the columns of the first electrode layer 231 through the first circuit unit 2411 of the flexible PCB 240 and also apply a voltage to at least one column among the electrodes 2321 in a plurality of the columns of the second electrode layer 232 through the second circuit unit 2412 of the flexible PCB 240.

The controller 180 can control the driver circuit 273 to apply a voltage to which electrode column.

The first circuit unit 2411 may be electrically connected to the electrode 2311 in a plurality of the columns of the first electrode layer 231 through a first electrode connection terminal 231*b*, and the second circuit unit 2412 may be electrically connected to the electrode 2321 in a plurality of the columns of the second electrode layer 232 through a second electrode connection terminal 232*b*.

The first circuit unit 2411 may be connected to the electrodes 2311 in a plurality of the columns of the first electrode layer 231 at one end of a first direction, and the second circuit unit 2412 may be connected to the electrodes 2321 in a plurality of the columns of the second electrode layer 232 at one end of a second direction.

Yet, this means a connected point only. The first circuit unit 2411 and the second circuit unit 2412 can be located flexibly according to space utilization.

As the first circuit unit 2411 is connected to the first electrode layer 231, it can be located in the same plane where the first electrode layer 231 is located. Likewise, as the second circuit unit 2412 is connected to the second electrode layer 232, it can be located in the same plane where the second electrode layer 232 is located. Therefore, the first circuit unit 2411 and the second circuit unit 2412 can be provided to different layers, respectively unless a separate structure such as a perforated portion 250 (described later) is provided.

Namely, the first circuit unit 2411 may be provided to a front side of the piezoelectric layer 211 and the second circuit unit 2412 may be provided to the backside of the piezoelectric layer 211.

In FIG. 7, for example, the first circuit unit 2411 is connected to the electrodes 2311 in a plurality of the columns of the first electrode layer 231 at one end of the first direction and the second circuit unit 2412 is connected to the electrodes 2321 in a plurality of the columns of the second electrode layer 232 at one end of the second direction, by which the present invention is non-limited.

For example, the first circuit unit 2411 and the electrodes 2311 in a plurality of the columns of the first electrode layer 231 may be connected to each other at both sides of the first direction and the second circuit unit 2412 and the electrodes 2321 in a plurality of the columns of the second electrode layer 232 may be connected to each other at both sides of the second direction. Through this, signal transfer time can be uniformized.

Figure 8:
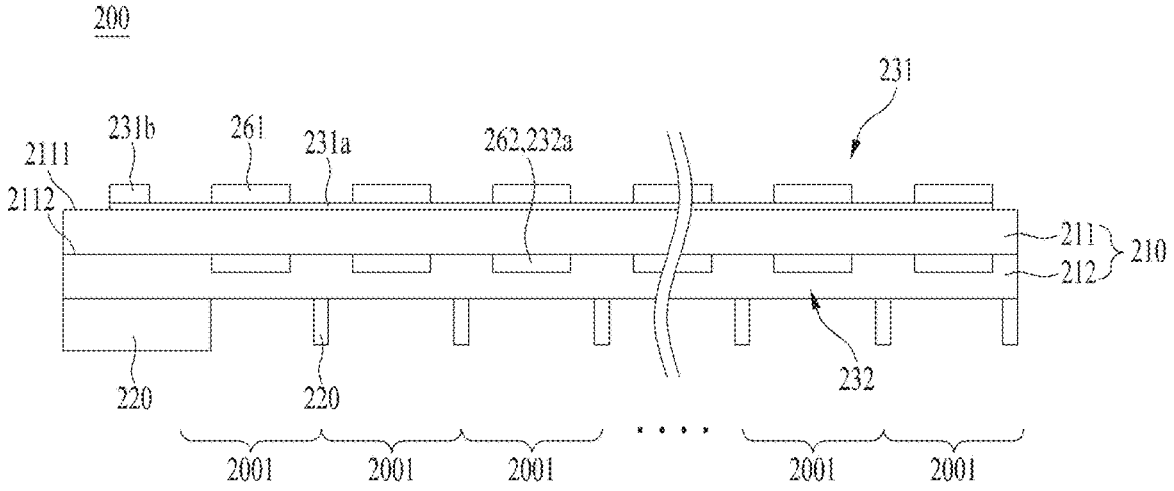
FIG. 8 is a cross-sectional diagram along a direction A-A' shown in FIG. 7.

FIG. 8 is a cross-sectional diagram along a direction A-A' shown in FIG. 7.

A cross-section of the drive module 200 may be configured in a manner that the drive unit 2001 shown in FIG. 6 is arranged transversely. Namely, the first electrode layer 231 and the second electrode layer 232 may be provided to the first face 2111 and the second face 2112 of the piezoelectric layer 211, respectively.

An electrodes may be provided to a location of each of the drive units 2001 of the piezoelectric layer 211, i.e., to an intersection between the first electrode layer 231 and the second electrode layer 232. Particularly, the electrode provided to the first face 2111 of the piezoelectric layer 211 may be defined as a first electrode 261, and an electrode provided to the second face 2112 that is the back of the first face 2111 of the piezoelectric layer 211 may be defined as a second electrode 262.

Namely, the first electrode layer 231 may be configured with a plurality of the first electrodes 261 and a first electrode connection wire 231*a* connecting the first electrodes 261 together, and the second electrode layer 232 may be configured with a plurality of the second electrodes 262 and a second electrode connection wire 232*a* connecting the second electrodes 262 together.

The first electrode layer 231 may be connected to the first circuit unit 2411 (cf. FIG. 7) of the flexible PCB 240 (cf. FIG. 7) through the first electrode connection terminal 231*b*. And, the second electrode layer 232 may be connected to the second circuit unit 2412 (cf. FIG. 7) of the flexible PCB 240 (cf. FIG. 7) through the second electrode connection terminal 232*b*. Yet, since FIG. 8 shows the cross-section in the direction A-A' of FIG. 7, such connection is not shown.

Figure 9:
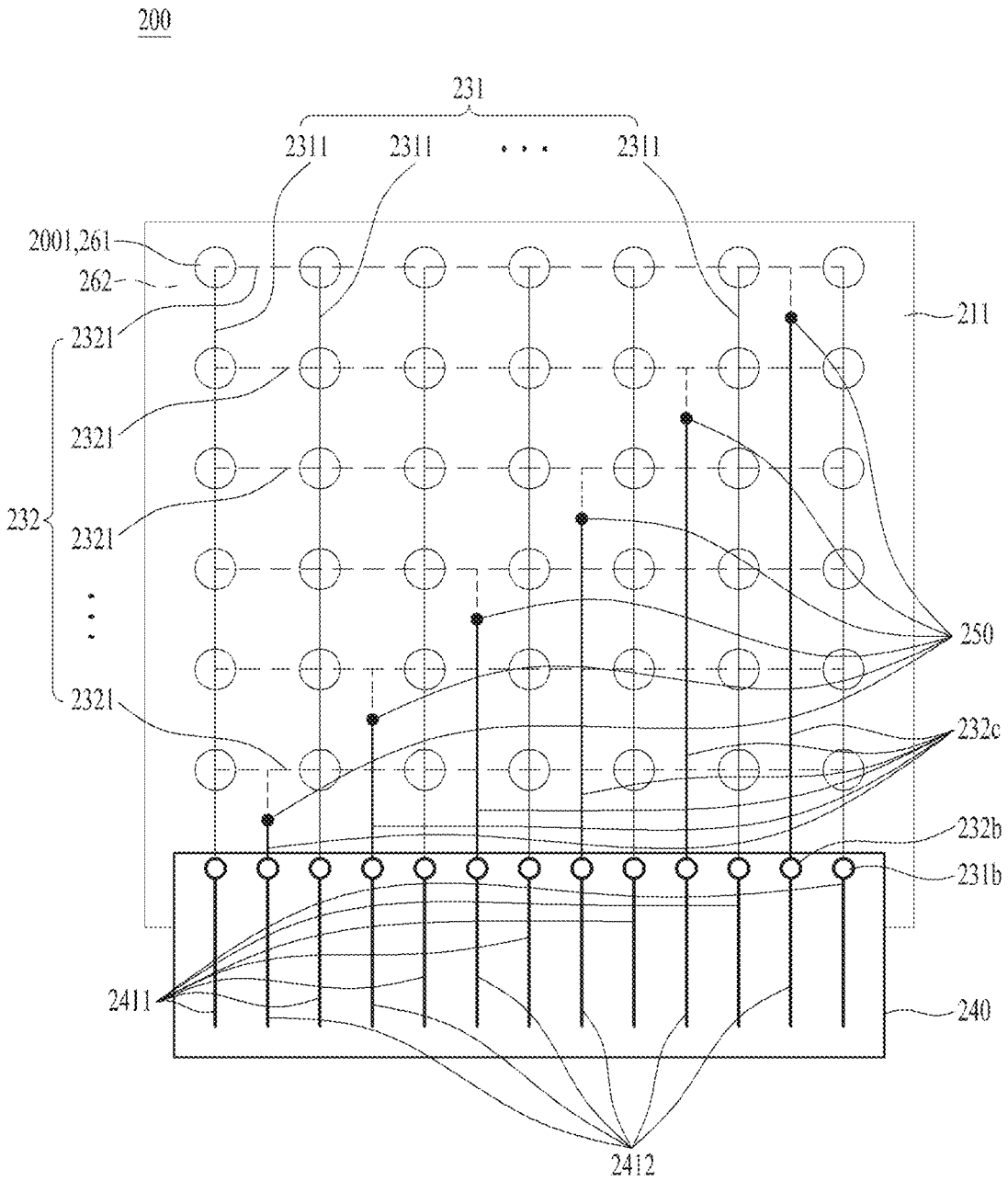
FIG. 9 is a schematic layout of a portion of a drive module of an audio output device related to the present invention.

FIG. 9 is a schematic layout of a portion of the drive module 200 of the audio output device 100 related to the present invention.

Like the above-described embodiment, if the first circuit unit 2411 and the second circuit unit 2412 are configured on different layers, respectively, a volume for such configuration in a vertical direction may be increased Moreover, if the first circuit unit 2411 and the second circuit unit 2412 are configured at one end of the first direction and one end of the second direction, respectively, a space occupied by the flexible PCB 240 in a horizontal direction may be increased inevitably.

Therefore, it is able to consider a method of minimizing a space in a vertical direction of the audio output device 100 by configuring the first and second circuit units 2411 on the same layer. And, it is also able to consider a method of minimizing a space in a horizontal direction of the audio output device 100 by configuring the first and second circuit units 2411 in a horizontal plane in the same direction.

Like the former embodiment, a plurality of column electrodes of the first electrode layer 231 may be provided to the first face 2111 of the piezoelectric layer 211 and a plurality of column electrodes of the second electrode layer 232 may be provided to the second face 2112 of the piezoelectric layer 211.

The first circuit unit 2411 may be configured as a plurality of columns at one end of the first direction so as to be connected to the electrodes 2311 in a plurality of columns of the first electrode layer 231, respectively.

Unlike the former embodiment, the second circuit unit 2412 may be configured on the same layer of the first circuit unit 2411 so as to be connected to the electrodes 2321 in a plurality of the columns of the second layer 232.

Namely, the first circuit unit 2411 and the second circuit unit 2412 can be provided to the front side of the piezoelectric layer 211.

An auxiliary connection wire 232*c* is connected to each of a plurality of the columns of the second electrode layer 232 on the rear side of the piezoelectric layer 211 and passes through at least one perforated hole 250 formed in the piezoelectric layer 211, thereby being provided across the front side of the piezoelectric layer 211.

The perforated holes 250 may be configured in a manner that the number of the perforated holes 250 is equal to the number of the electrode columns of the second electrode layer 232. This is because a plurality of the columns of the second electrode layer 232 should be driven independently.

The second circuit units 2412 may be configured in a manner that the number of the second circuit units 2412 is equal to the number of the electrode columns 2321 of the second electrode layer 232, thereby being connected to the electrode columns 2321 and further connected to a plurality of the auxiliary connection wires 232*c* in one-to-one correspondence.

The second circuit unit 2412 may be configured on the same lateral side of the first circuit unit 2411 in a horizontal direction of the drive module 200. Namely, like the first circuit unit 2411, the second circuit unit 2412 can be connected to the second electrode layer 232 at one end of the first direction.

The electrode columns 2321 of the second electrode layer 232 and the auxiliary connection wires 232*c* can be connected to each other by forming a specific angle in-between, respectively. For example, each of the electrode columns 2321 of the second electrode layer 232 and each of the auxiliary connection wires 232*c* can be configured vertical to each other.

The first circuit unit 2411 and the second circuit unit 2412 can be configured alternately. If so, a space can be used most efficiently and the possibility of interference occurrence due to the respective electrodes can be minimized.

A plurality of the perforated holes 250 may be configured in a column in a manner of being parallel to one column among a plurality of the column electrodes of the second electrode layer 232. Alternatively, a plurality of the perforated holes 250 may be configured at one point adjacent to each column connected like FIG. 9 so as to form a diagonal line.

According to the above embodiment, the auxiliary connection wires 232*c* are connected to the electrodes in a plurality of the columns of the second electrode layer 232 for example. On the contrary, it is a matter of course that the auxiliary connection wires 232*c* are configured to be connected to the electrodes in a plurality of the columns of the first electrode layer 231.

Yet, in this case, the first circuit unit 2411 and the second circuit unit 2412 may be connected to the electrode layers 231 and 232 on the backside of the piezoelectric layer 211, respectively.

Figure 10:
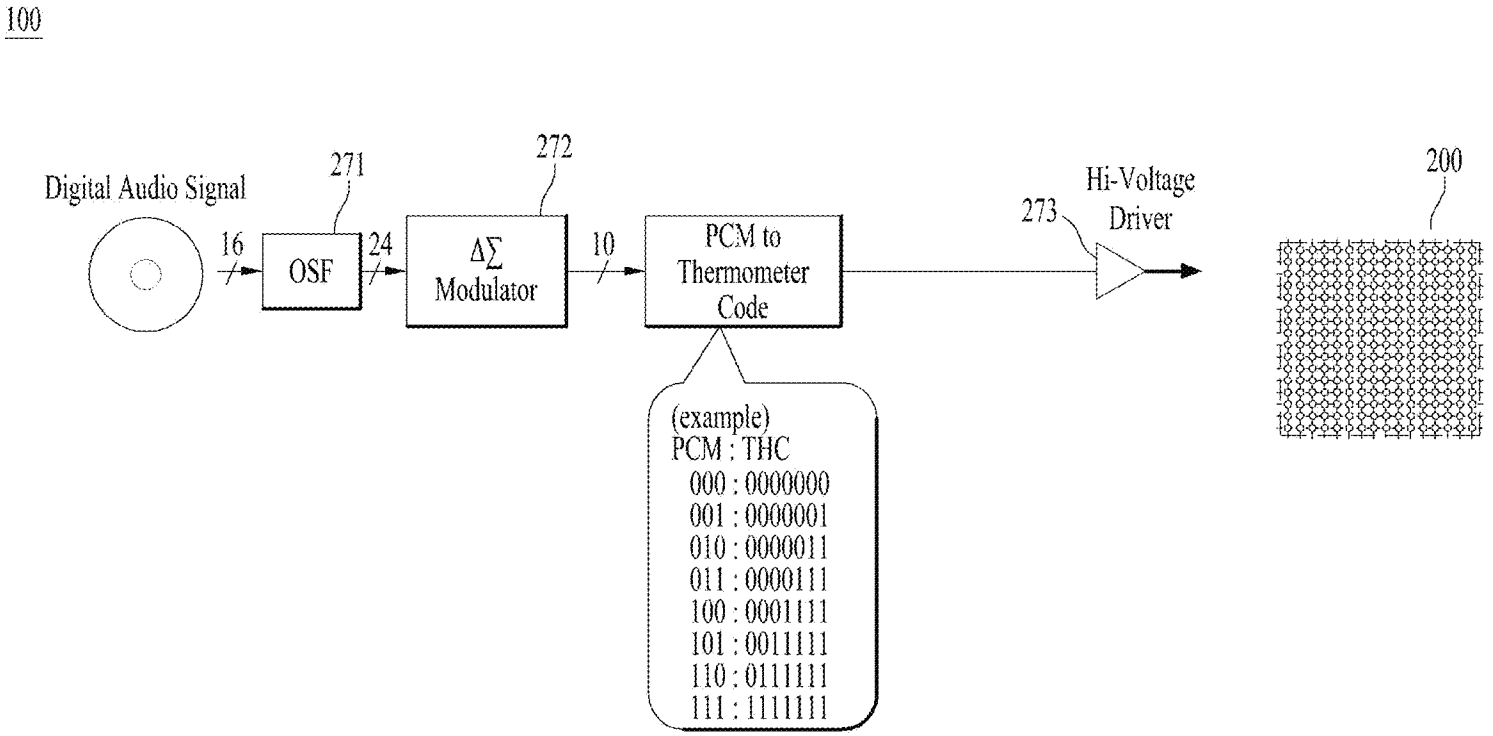
FIG. 10 shows a diagrammatized flow of a digital audio signal in association with an audio output device related to the present invention.

FIG. 10 shows a diagrammatized flow of a digital audio signal in association with the audio output device 100 related to the present invention.

A digital audio signal is filtered by an Over Sampling Filter (OSF) 271 and then modualted by a modulator 272, whereby a quantized signal is formed. In doing so, the targeted bit number may be determined as the number of vibating plates of a final end, i.e., the number of the drive units 2001. For example, if there are 1,023 drive units 2001, the length of the quantized signal can have 10 bits or less only. A binary code signal, which is a quantized signal, can be converted into a thermometer code. For example, although a decimal number '3' can be expressed as 011 of the 3-bit binary code, a termometer code can be expressed as 0000111. Such a hermometer code can be expresed as the number of the operating drive units 2001. A signal expreeses as a thermoeter code is supplied as a drive signal to the driver circuit 273, sent to the drive module 200, and then operates the drive unit 2001, whereby a sound pressure can be generated.

Namely, the driver circuit 273 can engage in a presence or non-prsence of a voltage relevant to a digital audio signal.

Figure 11:
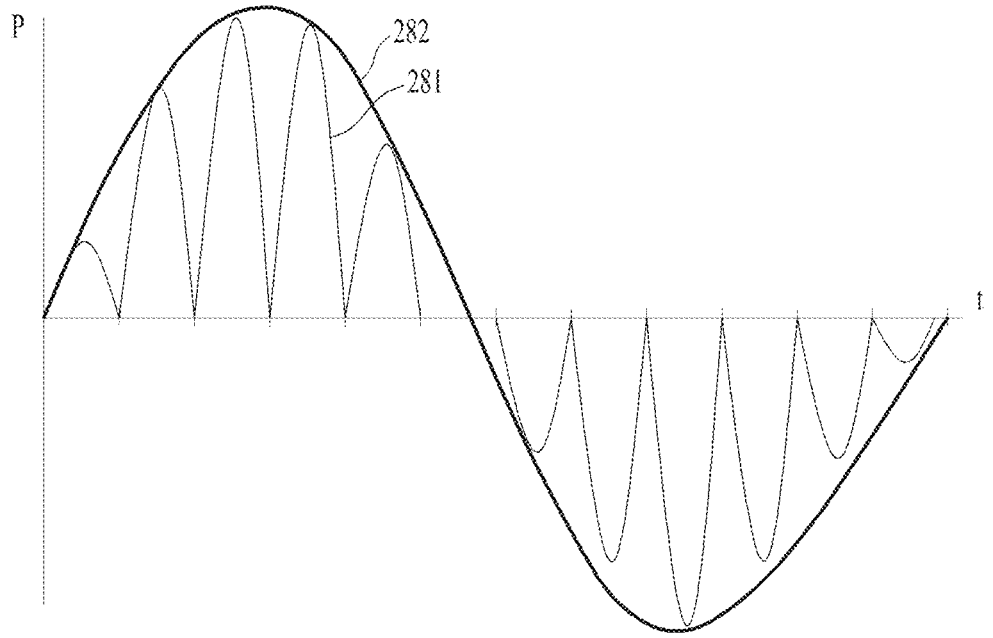
FIG. 11 shows a diagrammatized waveform of a sound pressure generated from an audio output device related to the present invention.

FIG. 11 shows a diagrammatized waveform of a sound pressure generated from the audio output device 100 related to the present invention.

Unlike an analog audio output device, the digital audio output device 100 may be delivered to random drive units 2001 in proportion to a size of a sound pressure of a drive signal having passed through the driver circuit 273. Namely, if the sound pressure is high, more drive units 2001 can vibrate. If the sound pressure is low, less drive units 2001 can vibrate.

Since a sound pressure fluctuation 281 generated by the drive unit 2001 deviates from an audible band, it fails to reach ears. A sound pressure fluctuation acording to an envelope 282 generated from conecting peaks of the generated sound pressure variations reaches ears.

Referring now to FIG. 6, since a sound pressure is proportional to an air amount, it is advantageous if the amplitude of the drive unit 2001 is as big as possible.

Since a sound presure is proportional to the square of an operating frequency, a high operating freqeuncy is good. Since an operating frequency twice higher than a sampling freqeuncy 44.1 KHz of a CD is necesary to secure a CD quality, an operating frequency of the drive unit 2001 needs to be set equal to higher than 100 KHz.

For enabling an operation in a stable range, a mechanizal resonant frequency may need to be several times higher than an operating frequency.

Yet, since a size of the drive unit 2001 is inversely proportional to a mechanical resontnat frequency, it is neceary to make efforts to increasing the number of the drive units 2001 rather tan enlarging the size of the drive unit 2001 lavishly in order to obtain a sound pressure.

At least some of the above-described compoents may cooperatively operate to implement operations of the audio output device 100 according to various embodiments described hereinbelow. And, an oepratio of the audio output device 100 can be implemented on the audio output device 100 by launching at least one appication program sotred in the memory 170.

MODE FOR INVENTION

Those skilled in the art will appreciate that the present disclosure may be carried out in other specific ways than those set forth herein without departing from the spirit and essential characteristics of the present disclosure.

The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

INDUSTRIAL APPLICABILITY

As described above, the present invention is applicable to all kinds of audio output devices entirely or in part.

What is claimed is:

1. An audio output device, comprising:

a first electrode layer including electrodes arranged in a plurality of columns in a first direction;

a second electrode layer provided to a backside of the first electrode layer, the second electrode layer including electrodes arranged in a plurality of columns in a second direction;

a drive layer including a piezoelectric layer provided between the first electrode layer and the second electrode layer and a support layer coupled to either a front side or a backside of the piezoelectric layer;

a flexible PCB providing voltage to the first electrode layer and the second electrode layer;

a driver circuit applying voltage to at least one of a plurality of the electrode columns of the first electrode layer and at least one of a plurality of the electrode columns of the second electrode layer through the flexible PCB; and a support plate coupled to a backside of the drive layer, the support plate having a hollow portion formed in an area corresponding to points at which the electrodes in a plurality of the columns of the first electrode layer and the electrodes in a plurality of the columns of the second electrode layer intersect with each other, respectively, wherein the piezoelectric layer and the support layer vibrate in response to an intersection between the voltage applied electrode columns of the first and second electrode layers.

2. The audio output device of claim 1, wherein intersections between the plurality of the electrode columns of the first electrode layer and the plurality of the electrode columns of the second electrode layer form a matrix of (n, m) (where the n and m are positive integers).

3. The audio output device of claim 1, the flexible PCB comprising:

a first circuit unit selectively applying the voltage to each of the electrodes in a plurality of the columns of the first electrode layer by being connected to the electrodes in a plurality of the columns of the first electrode layer at one side of the first direction; and a second circuit unit selectively applying the voltage to each of the electrodes in a plurality of the columns of the second electrode layer by being connected to the electrodes in a plurality of the columns of the second electrode layer at one side of the second direction.

4. The audio output device of claim 3, wherein the first circuit unit and the second circuit unit are provided to the front side and the backside of the piezoelectric layer, respectively.

5. The audio output device of claim 1, the flexible PCB comprising:

a first circuit unit selectively applying the voltage to each of the electrodes in a plurality of the columns of the first electrode layer by being connected to the electrodes in a plurality of the columns of the first electrode layer; and a second circuit unit selectively applying the voltage to each of the electrodes in a plurality of the columns of the second electrode layer by being connected to the electrodes in a plurality of the columns of the second electrode layer.

6. The audio output device of claim 5, further comprising:

a plurality of perforated holes formed in the piezoelectric layer; and an auxiliary connection wire connected to each of a plurality of the column electrodes of the second electrode layer on a rear side of the piezoelectric layer, the auxiliary connection wire provided across the front side of the piezoelectric layer by passing through the perforated hole, wherein the first circuit unit and the second circuit unit are provided to the front side of the piezoelectric layer and wherein the second circuit unit is connected to the auxiliary connection wire.

7. The audio output device of claim 6, wherein the first circuit unit and the second circuit unit are provided to one side of the first direction and wherein each of the electrode columns of the second electrode layer and each column of the auxiliary connection wire form a specific angle in-between.

8. The audio output device of claim 7, wherein the specific angle is vertical.

* * * * *